US006517959B1

(12) United States Patent
Beele

(10) Patent No.: US 6,517,959 B1
(45) Date of Patent: Feb. 11, 2003

(54) PRODUCT DESIGNED TO BE SUBJECTED TO THE EFFECTS OF HOT GAS AND METHOD FOR PRODUCING A COATING FOR THIS PRODUCT

(75) Inventor: Wolfram Beele, Ratingen (DE)

(73) Assignee: Siemens Aktiengesellschaft, Allemagne (DE)

( * ) Notice: Subject to any disclaimer, the term of this patent is extended or adjusted under 35 U.S.C. 154(b) by 0 days.

(21) Appl. No.: 09/530,639

(22) PCT Filed: Oct. 21, 1998

(86) PCT No.: PCT/DE98/03123

§ 371 (c)(1),
(2), (4) Date: Jul. 10, 2000

(87) PCT Pub. No.: WO99/23277

PCT Pub. Date: May 14, 1999

(30) Foreign Application Priority Data

Nov. 3, 1997 (DE) ..... 197 48 538

(51) Int. Cl.[7] ..... B32B 9/00; C23C 8/02; C23C 28/00

(52) U.S. Cl. ..... 428/698; 428/469; 428/472; 428/697; 428/699; 428/701; 428/702; 427/419.1; 427/419.2; 427/419.7

(58) Field of Search ..... 428/469, 472, 428/698, 699, 697, 701, 702; 416/241; 427/419.1, 419.2, 419.7

(56) References Cited

U.S. PATENT DOCUMENTS 4,852,542 A * 8/1989 Kamo et al. ..... 123/668
5,499,905 A * 3/1996 Schmidtz et al. ..... 416/241 R
6,129,988 A * 10/2000 Vance et al. ..... 428/469

* cited by examiner

*Primary Examiner*—Archene Turner
(74) *Attorney, Agent, or Firm*—Eckert Seamans Cherin & Mellott, LLC

(57) ABSTRACT

The invention relates to a product (1) designed for hot gas admission with a coating (3) in which chromium nitride (6) is inserted as a diffusion barrier to improve the long-term stability of the coating (3). The invention furthermore relates to a process for producing a coating (3) for a product designed for hot gas admission (1).

12 Claims, 1 Drawing Sheet

PRODUCT DESIGNED TO BE SUBJECTED TO THE EFFECTS OF HOT GAS AND METHOD FOR PRODUCING A COATING FOR THIS PRODUCT

FIELD OF THE INVENTION

The invention relates to a product designed for hot gas admission with a coating, particularly a gas turbine blade. The invention furthermore relates to a process for producing a coating for a product designed for hot gas admission.

The article entitled "Diffusion barrier coatings with active bonding, designed for gas turbine blades," by O. Knotek, E. Lugscheider, F. Löffler, W. Beele, in the "Proceedings of the 21st International Conference on Metallurgical Coatings and thin Films," San Diego, Calif., USA, Apr. 25–29, 1994, describes a diffusion barrier coating for a gas turbine blade. A gas turbine blade frequently has an oxidation or corrosion protective coating applied to a base material, typically a superalloy. Due to diffusion processes, brittle phases may form in the coating, which impairs the life of the gas turbine blade. The goal of the research is to develop a diffusion barrier between the base material and the coating, which simultaneously ensures good bonding of the coating to the base material. This is achieved by a chromium aluminum oxide nitride system (Cr—Al—O—N).

The object of the invention is to define a product designed for hot gas admission, which is provided with an improved coating with respect to its long-term stability. A further object of the invention is to define a process to produce a coating for a product designed for hot gas admission.

SUMMARY OF THE INVENTION

According to the invention, the product-related object is attained by a product designed for hot gas admission made of a base material to which a coating is applied comprising:

a) a protective MCrAlY coating comprising
   - at least one metal selected from the group (iron, cobalt, nickel), abbreviated as M;
   - chromium (Cr) with a content of at least 15 wt-%, particularly at least 20 wt-%;
   - aluminum (Al) and
   - yttrium (Y) and/or hafnium and/or a metal selected from the rare earth group, particularly scandium, lanthanum, or cerium;

b) an oxide layer, particularly with aluminum oxide and/or chromium oxide;

c) chromium nitride.

BRIEF DESCRIPTION OF THE DRAWINGS

The invention will now be described in greater detail, by way of example, with reference to the drawing in which.

DESCRIPTION OF THE PREFERRED EMBODIMENT

Figure 1:
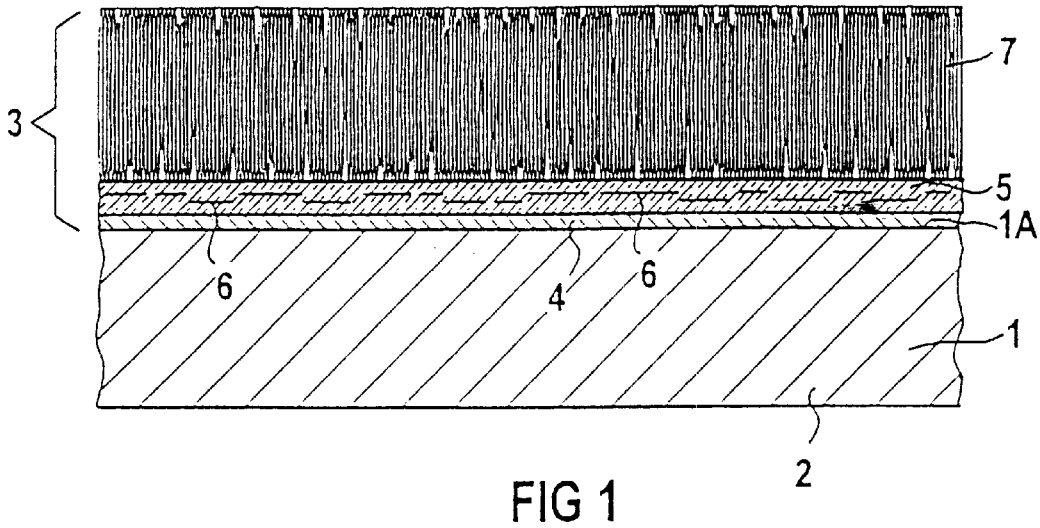
FIG. 1 is a longitudinal section through a coating of a product that can be subjected to a hot gas.

A product that can be subjected to a hot gas is frequently provided with a protective coating of the aforementioned type. Such a coating serves for oxidation and corrosion protection. On such a protective coating, an oxide layer forms upon contact with oxygen, which consists essentially of aluminum oxide and/or chromium oxide. The oxide layer can also be formed by oxidation of a thin film of an oxide former applied to the protective coating, such as aluminum or chromium. Over time, the protective layer is depleted of aluminum and chromium because aluminum and/or chromium diffuse into the oxide layer where they oxidize. This causes the oxide layer to increase. As a rule, this is a life-limiting aging process for the coating and impairs the mechanical properties of the growing oxide layer. To counteract this diffusion of aluminum and/or chromium to oxygen or vice versa, chromium nitride is inserted into the coating. The invention is thereby based on the surprising finding that sufficient amounts of chromium nitride can be formed in the protective coating if the chromium concentration exceeds 15 wt-%, preferably 20 wt-%. The chromium nitride acts as a particularly efficient diffusion barrier for the diffusion of aluminum and/or chromium to oxygen. This clearly improves the long-term stability of the coating.

Preferably, the protective coating contains rhenium, particularly in a proportion of between 1 wt-% and 15 wt-%. Here and in the following discussion, wt-% means weight percentage and at-% atomic percentage.

The chromium nitride is preferably contained in the oxide layer. Furthermore, the chromium nitride is preferably contained in a concentration of between 10 at-% and 60 at-%, particularly approximately 50 at-%. Preferably, the chromium nitride is present between the protective coating and the oxide layer, preferably in a junction region or as an anchoring region between the oxide layer and the protective coating.

Surprisingly, the chromium nitride can be formed as a lattice. Preferably, the chromium nitride forms such a lattice, particularly an approximately rectangular lattice with a lateral length of between 0.1 $\mu$m and 10 $\mu$m. The formation of such a lattice represents a particularly efficient diffusion barrier. Furthermore, the lattice structure decreases the coating's susceptibility to cracking, which further enhances the long-term stability of the coating.

The product is preferably designed as a turbine blade, particularly a gas turbine blade. Today, gas turbine blades are usually exposed to particularly high thermal stresses and intensive oxidation or corrosion attack. The life of a gas turbine blade coating thus typically determines the overhaul intervals of the entire blade. The product is preferably designed as a heat shield of a thermal machine, particularly for a combustion chamber.

Preferably a ceramic thermal barrier coating is applied to the oxide layer, particularly a zirconium-based thermal barrier coating. A ceramic thermal barrier coating serves to protect the turbine blade from very high temperatures. The ceramic thermal barrier coating is coupled to the protective coating via the oxide layer. Growth of the oxide layer results in increased brittleness of the oxide layer. This increased brittleness of the oxide layer has the effect of reducing the long-term stability of the coating due to greater susceptibility to peeling of the thermal barrier coating. The diffusion inhibiting action of the chromium nitride by slowing the growth of the oxide layer improves the long-term stability of the coating at a particularly susceptible point, namely the boundary layer between the thermal barrier coating and the protective coating.

According to the invention, the process-related object is attained by a process for producing a coating for a product designed for hot gas admission, whereby a) a protective MCrAlY coating comprising
   - at least one metal selected from the group (iron, cobalt, nickel), abbreviated as M, chromium (Cr) with a content of at least 15 at-%, particularly at least 20 at-%, aluminum (Al), and yttrium (Y) and/or hafnium and/or a metal selected form the rare earth group, particularly scandium, lanthanum, or cerium is applied to the product, b) an oxide layer, particularly with aluminum oxide and/or chromium oxide is formed on the protective coating, and c) chromium nitride is produced in the coating through a nitrogen supply.

Preferably the nitrogen is supplied by a nitrogen plasma source via a nitrogen plasma treatment. Furthermore, the coating is preferably supplied with a nitrogen plasma that contains hydrogen in addition as an oxygen getter. The provision of hydrogen, and this in non-molecular form, makes it possible to extract oxygen from the chromium oxide. This allows nitrogen to attach itself to the chromium, which causes the formation of chromium nitride. Furthermore, a direct voltage (BIAS) is preferably applied between the product and the nitrogen plasma source. This accelerates the production of chromium nitride since the nitrogen penetrates the product more efficiently. Preferably, a direct voltage of 50 V to 600 V, particularly 100 V to 300 V is applied.

Identical reference numbers in the figures have the same meaning.

FIG. 1 is a segment of a longitudinal section through a product 1 representing a gas turbine blade that can be subjected to a hot gas. Gas turbine blade 1 is made of a base material 2, e.g., a nickel-based superalloy. The gas turbine blade 1 has a surface 1A. On this surface 1A, a protective layer of MCrAlY is applied, preferably having the following concentrations:

Cr=chromium between 15 wt-% and 30 wt-%,

Al=aluminum between 6 wt-% and 15 wt-%

Y=yttrium and/or hafnium and/or a rare earth metal, particularly scandium, lanthanum or cerium, between 0.01 wt-% and 2 wt-%, M=nickel and/or cobalt and/or iron as the balance.

In addition, e.g. Rhenium or other additives may be included.

The protective coating 4 is followed by an oxide layer 5. This layer is shown greatly enlarged. Oxide layer 5 is followed by a ceramic thermal barrier coating 7, e.g. of yttrium-stabilizing zirconium oxide. In oxide layer 5, chromium nitride 6 is inserted. Chromium nitride 6 reduces diffusion of aluminum or chromium from the protective coating 4 to the oxide layer 5. This slows the growth in the thickness of the oxide layer 5. Since a thick oxide layer 5 results in an increased risk of peeling of thermal barrier coating 7, slowing the growth of oxide layer 5 increases the longterm stability of coating 3.

Figure 2:
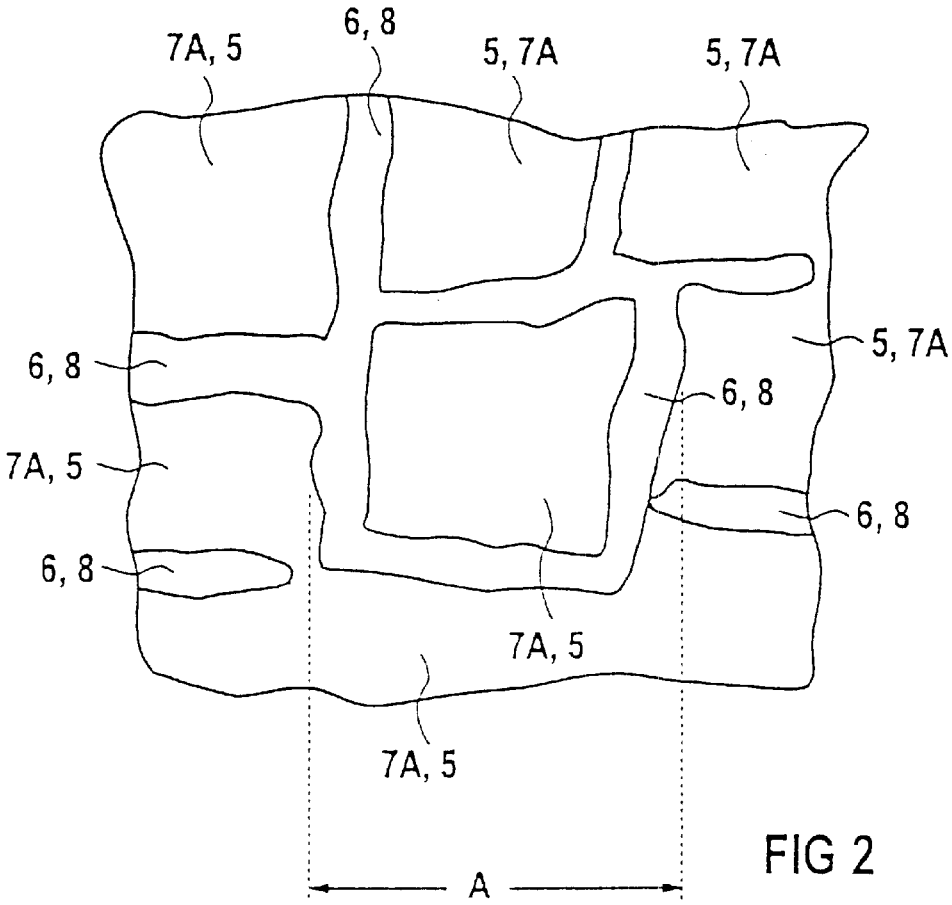
FIG. 2 is an enlarged schematic representation of a chromium nitride lattice in an oxide layer.

FIG. 2 shows an enlarged longitudinal section through an oxide layer 5. A lattice 8 of chromium nitride 6 formed of lattice cells 7A is schematically indicated. The interior of lattice cells 7*a* consists of aluminum oxide and/or chromium oxide. Lattice 8 is not geometrically perfect, i.e., it exhibits discontinuations, changing thicknesses, and changing surface areas of lattice cells 7A. On average, however, the approximate average lateral length A of a lattice cell 7A can be indicated. It preferably ranges between 0.1 $\mu$m and 5 $\mu$m. This average lateral length A depends, in particular, on the material of the protective coating and/or the oxide layer as well as on the process parameters during the formation of the chromium nitride. Such a lattice of chromium nitride 6 prevents a diffusion of aluminum or chromium particularly efficiently.

What is claimed is:

1. A product designed for hot gas admission made of a base material to which a coating is applied, comprising:

a) a protective coating of MCrAlY disposed on the base material, comprising:

at least one metal selected from the group (iron, cobalt and nickel), abbreviated as M, chromium (Cr) with a content of at least 15 wt-%, aluminum (Al), and yttrium (Y) and/or hafnium and/or a metal selected from the rare earth group;

b) an oxide layer disposed on the protective coating;

c) a ceramic thermal barrier coating disposed on the oxide layer; and chromium nitride included in the oxide layer.

2. A product designed for hot gas admission made of a base material to which a coating is applied, comprising:

a) a protective coating of MCrAlY disposed on the base material, comprising:

at least one metal selected from the group (iron, cobalt and nickel), abbreviated as M, chromium (Cr) with a content of at least 15 wt-%, aluminum (Al), and yttrium (Y) and/or hafnium and/or a metal selected from the rare earth group;

b) an oxide layer disposed on the protective coating;

c) a ceramic thermal barrier coating disposed on the oxide layer; and chromium nitride is present between the protective coating and the oxide layer.

3. The product as claimed in claim 1, wherein the chromium nitride is included in a concentration of between 10 at-% and 60 at-%.

4. The product as claimed in claim 1, wherein the chromium nitride forms an approximately rectangular or square lattice with a lateral length of between 0.1 $\mu$m and 5 $\mu$m.

5. The product as claimed in claim 1, which is designed as a turbine blade.

6. The product as claimed in claim 1, which is designed as a heat shield element of a thermal machine.

7. The product as claimed in claim 1, wherein the ceramic thermal barrier coating is a zirconium oxide-based thermal barrier coating.

8. A process for producing a protective coating for a product resistant to a hot gas, including the steps of:

a) applying the product of a protective coating of MCrAlY, comprising:

at least one metal selected from the group (iron, cobalt and nickel), abbreviated as M, chromium (Cr) with a content of at least 15 wt-%, aluminum (Al), and yttrium (Y) or hafnium or a metal selected from the rare earth group;

b) forming an oxide layer on the protective coating, and;

c) producing chromium nitride between the protective coating and the oxide layer via a nitrogen supply.

9. The process as claimed in claim 8, wherein the nitrogen supply is effected via a nitrogen plasma treatment.

10. The process as claimed in claim 8, wherein a nitrogen plasma from a nitrogen plasma source containing, in addition, hydrogen as an oxygen getter is supplied to the coating.

11. The process as claimed in claim 8, wherein a DC voltage, between 50 V and 600 V, is applied between the nitrogen plasma source and the product.

12. A process for producing a protective coating for a product resistant to a hot gas, including the steps of:

a) applying the product of a protective coating of MCrAlY, comprising:

at least one metal selected from the group (iron, cobalt and nickel), abbreviated as M, chromium (Cr) with a content of at least 15 wt-%, aluminum (Al), and yttrium (Y) or hafnium or a metal selected from the rare earth group;

b) forming an oxide layer on the protective coating, and;

c) producing chromium nitride in the oxide layer via a nitrogen supply.

* * * * *